US005105571A

United States Patent [19]

Kinchin et al.

[11] Patent Number: 5,105,571

[45] Date of Patent: Apr. 21, 1992

[54] METHOD AND APPARATUS FOR PREVENTING DIRT AND MOISTURE FROM ENTERING FIREARMS

[75] Inventors: Anthony E. Kinchin, West Midland, England; Thomas Angelini, Pittsfield, Mass.

[73] Assignee: Product Technologies, Inc. c/o Pen-Ro Group, Pittsfield, Mass.

[21] Appl. No.: 599,812

[22] Filed: Oct. 18, 1990

[51] Int. Cl.[5] ..... F41A 35/04

[52] U.S. Cl. ..... 42/96

[58] Field of Search ..... 42/96

[56] References Cited

U.S. PATENT DOCUMENTS 2,385,051 9/1945 Berlin et al. ..... 42/96
2,465,163 3/1949 Lockwood ..... 42/96
3,354,569 11/1967 Kassabian ..... 42/96

FOREIGN PATENT DOCUMENTS 361315 6/1906 France ..... 42/96
23895 of 1915 United Kingdom ..... 42/96

*Primary Examiner*—Charles T. Jordan
*Attorney, Agent, or Firm*—Needle & Rosenberg

[57] ABSTRACT

A method and apparatus for protecting firearms from dirt and moisture are disclosed. Light-weight plastic covers are used to seal the openings of a firearm such as the muzzle opening or the magazine well opening. These protective covers are easily removable by simple manual operations. This muzzle cover can also be removed by actually firing the firearm, while imparting no significant deflection to the projectile.

12 Claims, 2 Drawing Sheets

METHOD AND APPARATUS FOR PREVENTING DIRT AND MOISTURE FROM ENTERING FIREARMS

BACKGROUND OF THE INVENTION

This invention relates to protective systems for firearms, and more specifically, a method and apparatus for preventing dirt and moisture from entering into the firing mechanism of a firearm.

Military weapons often find use in harsh geographical conditions. For instance, the windblown sand environment found in deserts, such as in Saudi Arabia, is probably the worst case situation for weapon contamination. The fine desert sand can find its way into every orifice of a rifle or other firearm. While little damage or operational interference will result from sand intrusion into many of the weapons openings, two openings present direct access to the weapons operating system where sand or water could and would most likely cause catastrophic system failure. The two areas of concern are, the magazine well when an ammunition magazine is not attached, and the muzzle end of the rifle.

As an example, the M16A2 rifle is a superior combat weapon designed and produced to exacting tolerances. Like all closed bolt rifles, however, the M16A2 is susceptible to malfunction when contaminants such as sand, dirt or mud find their way into the weapons' operating mechanism.

Therefore, it is an object of the present invention to provide a method and apparatus for preventing contaminants from entering the open muzzle of the rifle or an open magazine well of the rifle, when the weapon is not in use.

It is a further object of the present invention to provide a method and apparatus for preventing entry of contaminants into an unused weapon, which may be easily and quickly removed to meet the requirements of combat conditions.

It is a further object of the present invention to provide an apparatus for covering the open muzzle of a firearm which allows the firearm to be safely discharged if it is fired while the cover is engaged to the muzzle.

It is another object of the present invention to provide a cover for the magazine well which may be easily removed with one finger whether the weapon is being used by a left-handed or right-handed person.

SUMMARY OF THE INVENTION

The above objects are satisfied by the present invention by providing a muzzle cover and a magazine well cover to be placed over the respective orifices of a weapon in order to prevent the entry of contaminants into the weapon.

The method of the present invention involves covering the open muzzle and open magazine well cover of a weapon with fast-action removable caps which snap onto the orifices. Then, when the weapon is ready to be used, the two caps can be quickly removed from the weapon and a normal magazine can be inserted into the magazine well. Alternatively, the cap to cover the muzzle may be one designed to be removed by actual firing of the weapon.

The apparatus of the present invention comprises separately and in combination a device for covering the muzzle of a weapon and a device for covering the magazine well.

First, the muzzle cover is a cap device that snaps over the muzzle to prevent the intrusion of sand, water or other debris from entering the weapon's barrel. For instance, on an M16A2, the muzzle cover snaps over the muzzle compensator. The cover is produced from low density polyethylene material. It is solid and is retained on the weapon by its compression fit. The cap can be installed by the user without tools by pressing it over the muzzle of the weapon. It can be removed by hand by pulling it directly off of the barrel, preferably by a ridge which extends outward around the rim of the cap which gives leverage so that the cap may be removed by pushing on the ridge with a thumb. In the heat of battle, it is important that the cover be removed as quickly as possible. Furthermore, it is possible that a soldier or other user of a weapon may forget to remove the muzzle cover. For both of these reasons, it is desirable to have a muzzle cover which can be safely removed by the firing of the weapon. Therefore, in the present invention, a muzzle cover is designed so that a projectile being fired will pass harmlessly through the cap and continue downrange without deflection, while the escaping gases will expand the cap and blow it clear of the weapon.

Second, the invention comprises a magazine well cover which is also made of low density polyethylene. The magazine well cover is designed to be compressed over the magazine well opening on the bottom of the magazine receiver. This cover comprises a cap which will provide a near air-tight fit over the well opening. The cap is designed with a ridge around its periphery which will permit the user to easily grab and remove the cap by pulling directly down on it. In addition, two large flat tab surfaces are located on the left and right front end of the cover near the trigger housing mechanism to permit the user to quickly detach the cover by pushing downward with his thumb. The flat surface has been provided on both sides of the cover to compliment the ambidextrous nature of weapons such as the M16A2 rifle.

These and other objects and advantages will appear from the following description with reference to the drawings.

DESCRIPTION OF PREFERRED EMBODIMENT

The preferred embodiment is now described with reference to the drawings, in which like numbers indicate like parts throughout the views.

Figure 1:
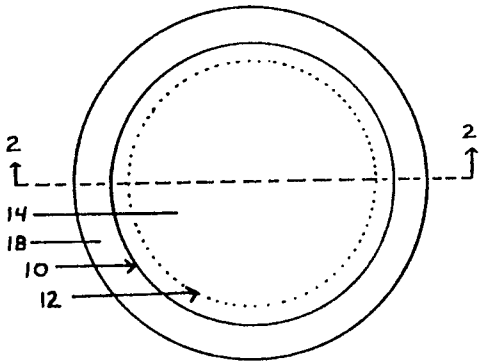
FIG. 1 is a top view of the muzzle cover of the present invention.
Figure 2:
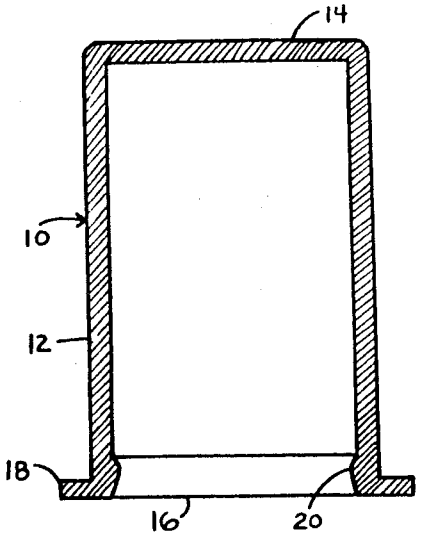
FIG. 2 is a cross section view of the muzzle cover of FIG. 1, taken along line 2—2 of FIG. 1.

FIGS. 1 and 2 show a muzzle cover, and more specifically, a muzzle cover designed for an M16A2 rifle muzzle. The muzzle cover 10 is a single piece of molded low density polyethylene or other plastics material. The cover 10 generally comprises a cylindrical portion 12 having a closed end 14 and an open end 16. A ridge portion 18 of the muzzle cover 10 extends outwardly from the cylindrical portion 12 at or near the open end of the cylinder 12 and is generally perpendicular to the axis of the cylinder. At or near the open end of the cylindrical portion 12 is a rib 20 located on the inside periphery of the cylindrical portion 12. The purpose of the rib 20 is to retain the muzzle cover 10 on the end of the muzzle by having the rib extend beyond a raised portion of the end of the muzzle, such as the muzzle compensator of the M16A2 rifle. Therefore, the length of the cylindrical portion 12 of the muzzle cover should be of sufficient length that the rib 20 will fit over a raised portion of the muzzle of the rifle to hold the cover 10 in place.

The end 14 of the muzzle cover 10 should be sufficiently thin so as to allow a projectile being discharged from the rifle to pass through the muzzle cover 10 with no significant deflection of the projectile. A thickness of approximately 4/100 of an inch has been found to be suitable for the muzzle cover. Also, in the preferred embodiment, the ridge 18 may be advantageously placed closer to the open end of the cylindrical portion 12 than the rib portion 20 such that the ridge portion 18 may provide a lever action to pull the adjacent portion of the rib 20 over a raised portion of the muzzle end of a weapon so that the muzzle cover may be easily and quickly removed from the weapon by manual means.

Figure 3:
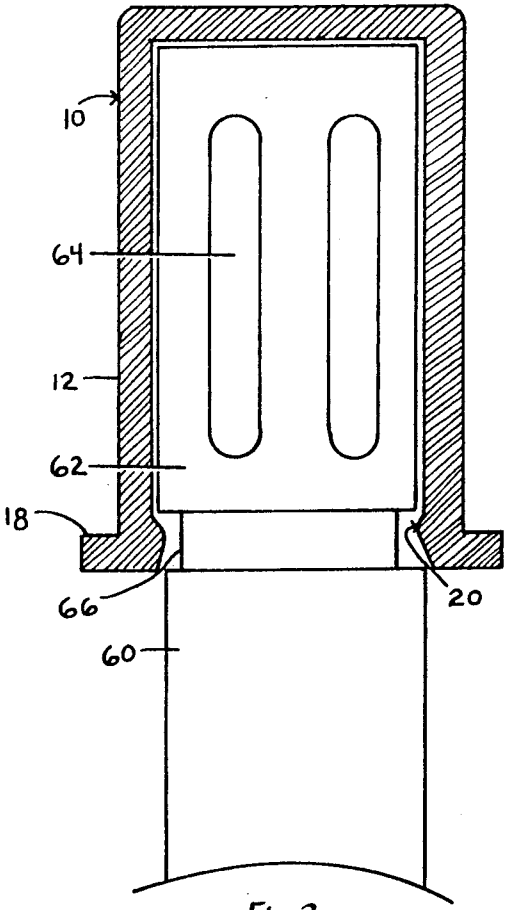
FIG. 3 shows the muzzle cover of FIG. 2 installed on a rifle muzzle having a muzzle compensator.

FIG. 3 shows the muzzle cover 10 installed on a rifle muzzle 60 having a muzzle compensator 62 which has openings 64 on the side which allow exhaust gases to exit through the openings 64 as well as the muzzle opening. FIG. 3 shows the end of a muzzle as it exists on an M16A2. The muzzle compensator 62 ends at a groove 46 into which the rib 20 of the muzzle cover 10 may fit. The inside diameter of the muzzle cover should be about 1/100 of an inch wider than the outside diameter of the muzzle compensator 62 so that the gases exiting from the muzzle when a round is fired will circulate around the inside of the cylinder 12 and expand and lift the muzzle cover 10 away from the muzzle, allowing it to be blown away harmlessly forward.

Figure 6:
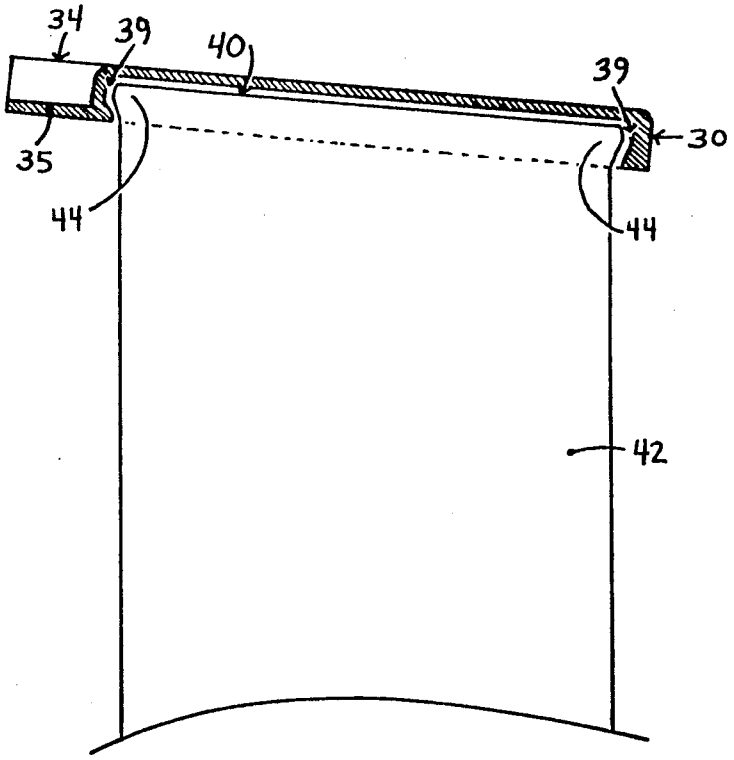
FIG. 6 shows the magazine well opening cover of FIG. 5 located in place on the end of a magazine receiver.
Figure 5:
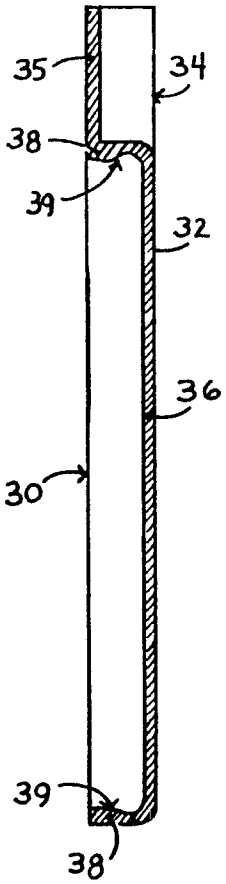
FIG. 5 is a cross-sectional view of the magazine well opening cover of FIG. 4, taken along line 4—4 of FIG. 4.
Figure 4:
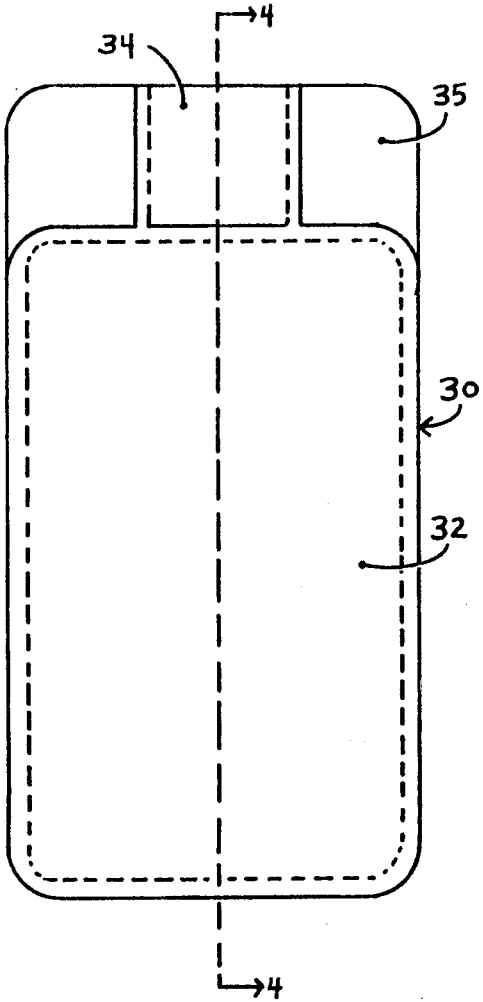
FIG. 4 is a top view of the magazine well opening cover of the present invention.

A magazine well opening cover of the present invention is shown in FIGS. 4, 5 and 6. The cover 30 shown in FIG. 4 is generally rectangular and comprises a cap portion 32 and a tab extension portion 34. The periphery of the cap portion 32 of the magazine well cover 30 has the same shape and dimensions as the outside of the open end 40 of the weapons' magazine receiver 42, as shown in FIG. 6 FIGS. 4–6 generally describe the size and shape of the invention as it would be used on an M16A2 rifle.

The cap portion 32 of the magazine well cover 30 comprises a flat closed end 36 to cover the magazine well opening with sides 38 extending generally perpendicularly away from the end 36 of sufficient width to maintain the cap in place around the opening 40 of the magazine receiver 42. A rib 39 is located at the open end of the cap portion 32 formed by the sides 38, on the inside periphery of the sides 38, to assist in holding the cap in place around a raised or flared portion 44 at the end of the magazine receiver 42.

An extension portion 34 of the magazine well cover 30 extends from at least one of the sides of the cap portion 32 of the cover 30. As shown in FIGS. 4 and 5, the extension portion 34 extends from one of the narrow sides of the cap portion 32 in generally the same plane as the end 36 of the cap portion 32. The extension portion comprises tab portions 35 to be used to remove the cover 30 from the magazine receiver 42. As with the muzzle cover, the tab portion 35 extends from the side 38 at the open end of the side 38 to provide a lever action to help easily pull the adjacent portion of the rib 39 away from the magazine receiver flared portion 44. This allows the magazine well cover 30 to be quickly removed by pushing on it with a thumb. Since rifles, such as the M16A2, generally are designed to allow use by either left-handed or right-handed persons, the magazine well cover 30 preferably has a tab portion on both the left side and the right side of the cover so that it may be removed easily from either side.

While this invention has been described in detail with particular reference to the preferred embodiment thereof, it will be understood that variations and modifications can be effected with the spirit and scope of the invention as previously described and as defined in the claims.

We claim:

1. A muzzle cover for a firearm muzzle opening to prevent entry of contaminants, said cover comprising:

a cylindrical portion having a closed end and an open end, a rib to retain the muzzle cover on the firearm muzzle, said rib being located on the inside periphery of the cylindrical portion, such that said muzzle cover may be removably attached to said muzzle.

2. The cover as recited in claim 1 further comprising a ridge portion extending outwardly from the cylindrical portion at or near the open end of the cylindrical portion.

3. The cover as recited in claim 1, wherein the closed end is sufficiently thin so as to allow a projectile being discharged from the firearm to pass through the cover with no significant deflection.

4. The cover as recited in claim 3, wherein the closed end is approximately 4/100 of an inch thick to allow no significant defection of the projectile.

5. The cover as recited in claim 1, wherein said cover is made of a single piece of molded low density plastics material.

6. A muzzle cover for a firearm muzzle opening to prevent entry of contaminants comprising a means for sealing said muzzle opening when said cover is attached to the muzzle, wherein said sealing means allows exhaust gases exiting from the firearm muzzle to circulate around the inside of the sealing means to expand and lift the cover away from the muzzle when the firearm is discharged, and wherein said sealing means comprises a cylindrical portion having a closed end and an open end and a rib to retain the muzzle cover on the firearm muzzle, said rib being located on the inside periphery of the cylindrical portion.

7. A cover as recited in claim 6, wherein said rib fits in a groove formed on a firearm having a muzzle compensator.

8. A cover as recited in claim 7, wherein the inner diameter of said cylindrical portion is about 1/100 of an inch wider than the outside diameter of the muzzle compensator to allow the circulation of the exhaust gases.

9. A protective cover for a firearm magazine well opening comprising:

(a) a cap portion for sealing the magazine well opening, wherein said cap portion comprises a flat closed end for covering the magazine well opening, sides extending generally perpendicularly away from the closed end to form an open end, and a rib located at the open end on the inside periphery of the sides, wherein the sides are of sufficient width to maintain the cap in place around the magazine well opening and said rib assists in holding the cap portion in place over the magazine well opening; and (b) a tab portion extending from the cap portion for easily removing the cover from the magazine well opening.

10. A cover as recited in claim 9, wherein said tab portion extends from at least one of the sides of the cap portion and in generally the same plane as the end of the cap portion.

11. A cover as recited in claim 9, wherein said tab portion extends from opposed sides of the cap portion such that said cover may be removed by left-handed or right-handed persons.

12. A cover as recited in claim 9, wherein said tab portion is located at the open end of the side of the cap portion to provide leverage for ease of removal of the cover.

* * * * *